US006530829B1

(12) United States Patent
Kramer

(10) Patent No.: US 6,530,829 B1
(45) Date of Patent: Mar. 11, 2003

(54) CMP PAD HAVING ISOLATED POCKETS OF CONTINUOUS POROSITY AND A METHOD FOR USING SUCH PAD

(75) Inventor: Steve Kramer, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/941,645

(22) Filed: Aug. 30, 2001

(51) Int. Cl.[7] ..... B24B 37/04
(52) U.S. Cl. ..... 451/527; 451/526; 451/921
(58) Field of Search ..... 451/921, 527, 451/530, 537; 156/645.1, 653; 51/293, 296

(56) References Cited

U.S. PATENT DOCUMENTS 5,177,908 A * 1/1993 Tuttle ..... 451/527
5,329,734 A * 7/1994 Yu ..... 451/527
5,489,233 A * 2/1996 Cook et al. ..... 451/41
5,578,362 A * 11/1996 Reinhardt et al. ..... 428/147
5,795,218 A * 8/1998 Doan et al. ..... 451/526
5,853,317 A * 12/1998 Yamamoto ..... 451/288
5,976,000 A * 11/1999 Hudson ..... 451/534
6,030,488 A 2/2000 Izumi et al.
6,089,965 A * 7/2000 Otawa et al. ..... 451/527
6,203,407 B1 3/2001 Robinson
6,238,271 B1 * 5/2001 Cesna ..... 451/41
6,325,702 B2 * 12/2001 Robinson ..... 451/41
6,332,832 B1 * 12/2001 Suzuki ..... 451/41
6,354,929 B1 * 3/2002 Aderfis ..... 451/527

* cited by examiner

*Primary Examiner*—George Nguyen
(74) *Attorney, Agent, or Firm*—Dickstein Shapiro Morin & Oshinsky LLP

(57) ABSTRACT

A chemical mechanical polishing pad and a system and a method for using such a pad are described. The polishing pad includes pockets of continuous porosity, each of the pockets being separated from the other pockets by a non-porous matrix. The non-porous matrix may include a network of trenches, or may have pores which have been filled with a material. The material may include a polymer resin. A system for polishing a wafer includes the polishing pad mounted on a platen. A drive assembly creates relative rotation between the wafer and the polishing pad through a drive shaft. The drive shaft may be connected to the platen or it may be connected to a wafer holder which holds the wafer. Alternatively, one drive shaft may be connected to the platen and another drive shaft may be connected to the wafer holder, and a pair of drive assemblies drive the drive shafts.

11 Claims, 7 Drawing Sheets

FIG. 6
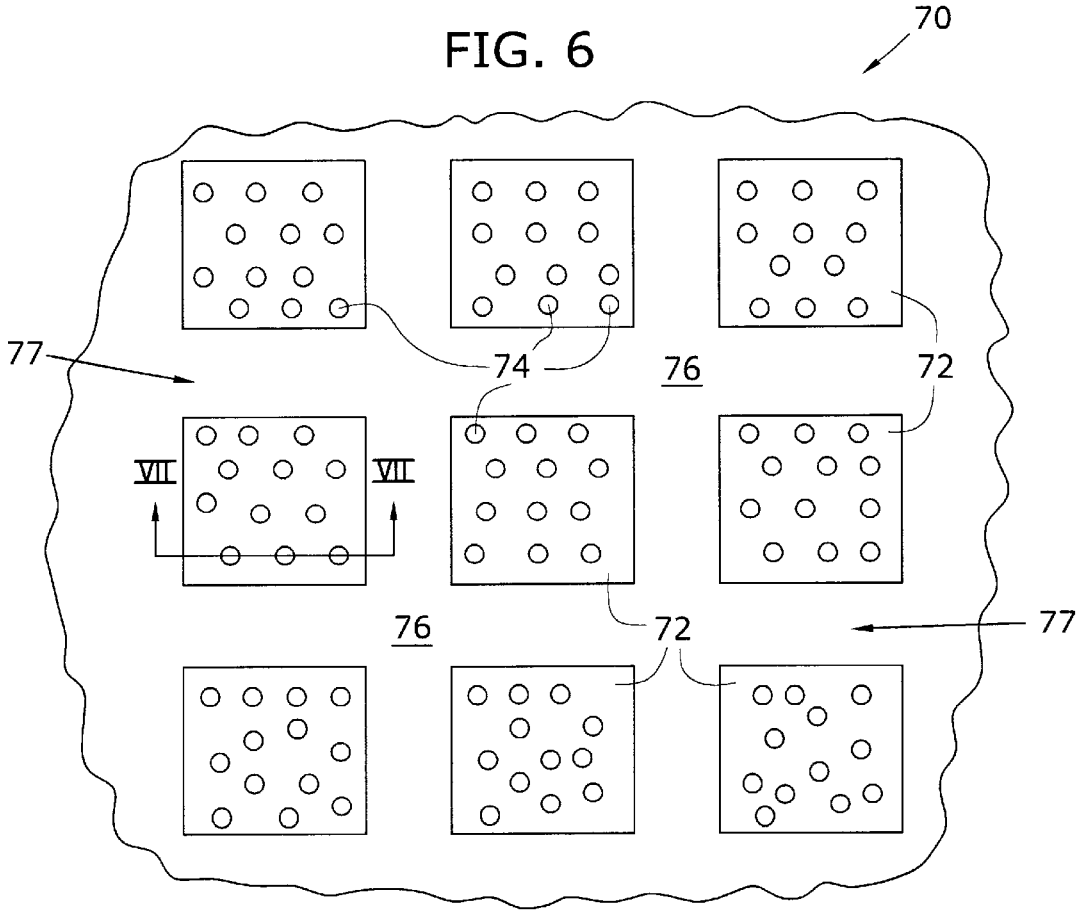
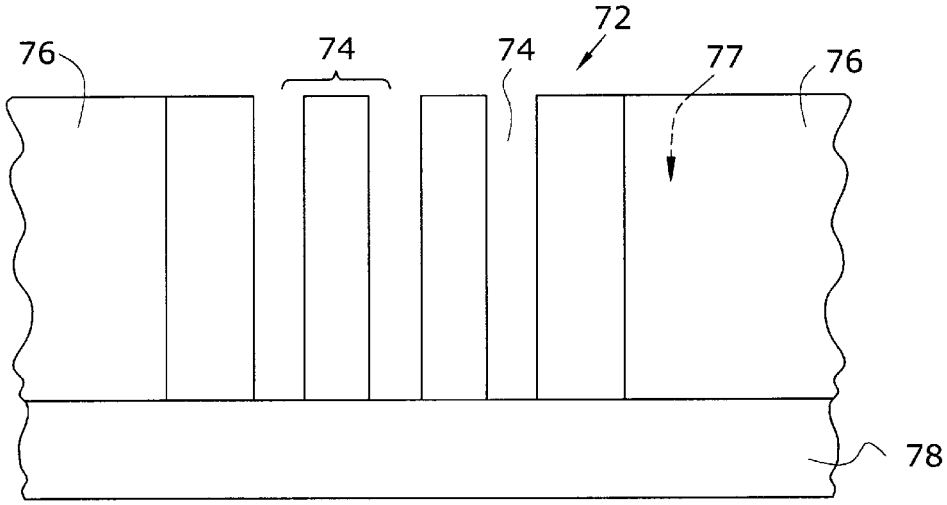
FIG. 7

CM P PAD HAVING ISOLATED POCKETS OF CONTINUOUS POROSITY AND A METHOD FOR USING SUCH PAD

BACKGROUND

Chemical mechanical polishing (CMP) is widely known in the semiconductor fabrication industry. CMP pads are used to planarize wafers after some other wafer fabrication process has been performed. Some CMP pads are non-porous, such as the solid and grooved model OXP 3000 manufactured by Rodel. Other CMP pads have continuous porosity throughout the entire pad, such as Cabot Microelectronics' Epic model, which is formed of polyurethane, or Rodel's Suba IV model, which is formed of interlocking felt fiber. Continuous porosity means that there are pores throughout the pad, and the pores are interconnected. Still other CMP pads have isolated porosity, such as Rodel's IC1000 and Rhodes' ESM-U. Isolated porosity means that while pores may be located throughout the pad, the pores are not interconnected.

A problem encountered with continuously porous CMP pads is that a higher level of wafer defects is experienced when compared with non-porous pads. As an example of this, a shallow trench isolation (STI) polish and a polish on borophosphosilicate glass (BPSG) layer polish were performed with the continuously porous Cabot Epic pad. While several important polishing characteristics were found to be good, the proportion and severity of scratches on the wafers was unacceptably high. For the BPSG layer polish, the defect levels were on an order of magnitude difference compared to expected defect levels.

In general, however, continuously porous pads are more desirable than non-porous pads. Porous pads have a rough surface texture which is beneficial to polishing, since it promotes slurry transport and provides localized slurry contact. As porous pads wear, the homogeneous porosity allows a similar texture with polish and conditioning to be maintained, since a new, porous, rough surface is constantly being regenerated.

It is believed that the higher level of defects from conventional continuously porous CMP pads may be due to a lack of sufficient hydrodynamic lift during the polishing process. With reference to FIGS. 1–3, a wafer 10 is illustrated juxtaposed with a continuously porous CMP pad 14. A slurry 12 is transported in a direction A relative to the wafer 10 and the pad 14. Some of the slurry 12 infiltrates pores 16 of the pad 14. As a force is directed against the wafer 10 in a direction B, the slurry 12 tends to further migrate in a direction C into the pores 16 of the pad 14. This prevents the building up of a sufficient hydrodynamic lift in the slurry 12, causing large slurry particles 18 to contact the wafer with increased force (FIG. 3).

FIG. 4 illustrates a non-porous CMP pad 30 with grooves 32. During polishing, pressure builds up in the slurry 12, creating a hydrodynamic lift in a direction D. FIG. 5 shows a CMP pad 40 with isolated pores 42. As polishing commences, a hydrodynamic lift is created in a direction E in the slurry 12. Both hydrodynamic lifts D and E illustrated in respectively FIGS. 4 and 5 assist in suppressing the force with which slurry particles, including the large slurry particles 18, strike the wafer 10.

There is therefore a need for a CMP pad which has the advantages of a continuously porous pad without its attendant disadvantages.

SUMMARY

The invention provides a chemical mechanical polishing pad that includes a plurality of continuously porous sections and a non-porous section which separates the continuously porous sections from one another. Such a polishing pad retains the hydrodynamic lift associated with non-porous pads but with the enhanced performance of continuously porous pads.

The invention further provides a polishing system which includes a drive assembly, a drive shaft in connection with the drive assembly, a platen, and a polishing pad mounted on the platen and adapted to receive a wafer for polishing. The polishing pad includes a plurality of continuously porous sections and a non-porous section which separates the continuously porous sections from one another. The drive assembly rotates either the platen/polishing pad or the wafer, or both.

The invention also provides a method for polishing a wafer. The method includes the steps of contacting a wafer with a polishing pad and creating relative rotation between the wafer and the polishing pad. The polishing pad includes a plurality of continuously porous sections and a non-porous section which separates the continuously porous sections from one another.

The invention additionally provides a method for fabricating a polishing pad which has continuously porous regions. The method comprises forming non-porous regions on the polishing pad in a pattern which segregates porous regions from one another.

These and other advantages and features of the invention will be more readily understood from the following detailed description of the invention which is provided in connection with the accompanying drawings.

BRIEF DESCRIPTION OF THE DRAWINGS

FIG. 6 is a partial schematic top view of a CMP pad constructed in accordance with an embodiment of the invention.

FIG. 7 is a partial cross-sectional view taken along line VII—VII of FIG. 6.

DETAILED DESCRIPTION OF PREFERRED EMBODIMENTS

Figure 1:
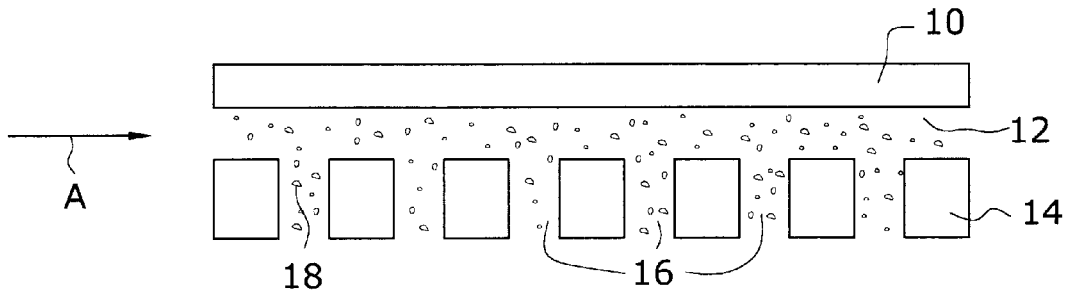
FIG. 1 Prior Art
FIGS. 1–3 are schematic side views of a conventional continuously porous CMP pad as it polishes a wafer.
Figure 2:
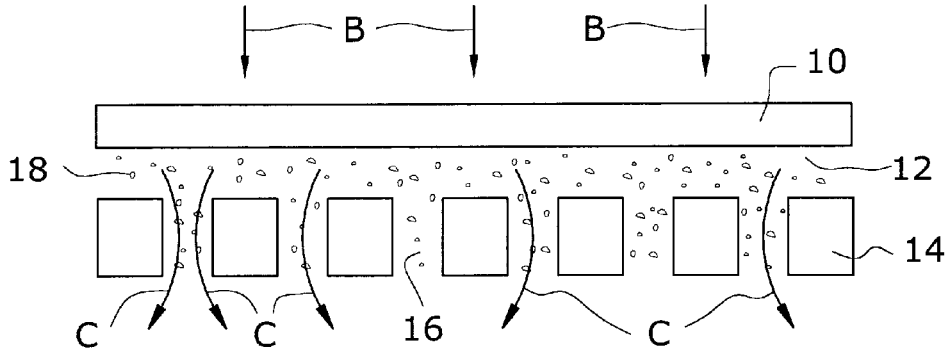
FIG. 2 Prior Art
Figure 3:
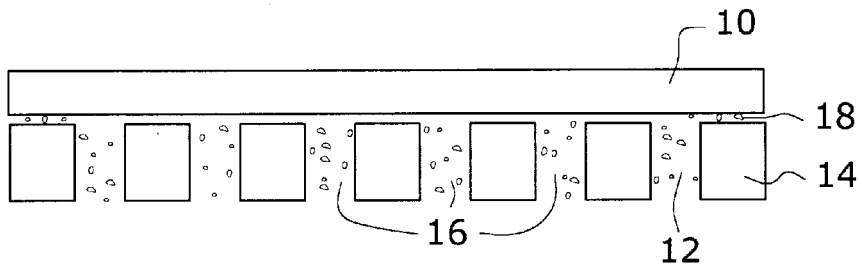
FIG. 3 Prior Art
Figure 4:
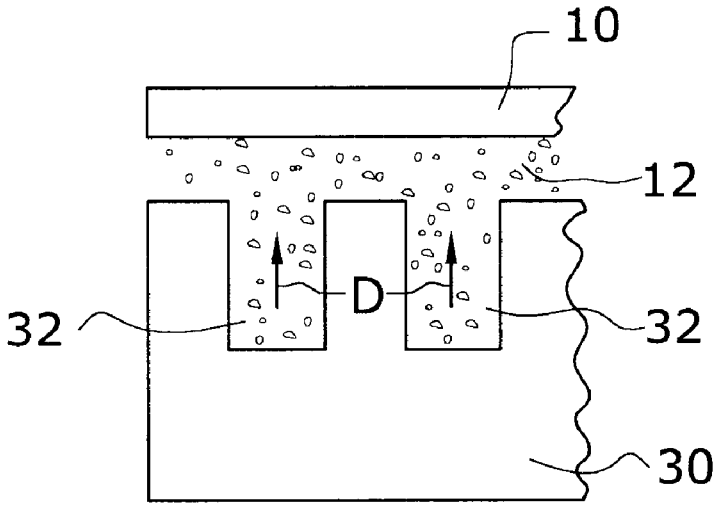
FIG. 4 Prior Art
FIG. 4 is a partial schematic side view of a conventional non-porous CMP pad as it polishes a wafer.
Figure 5:
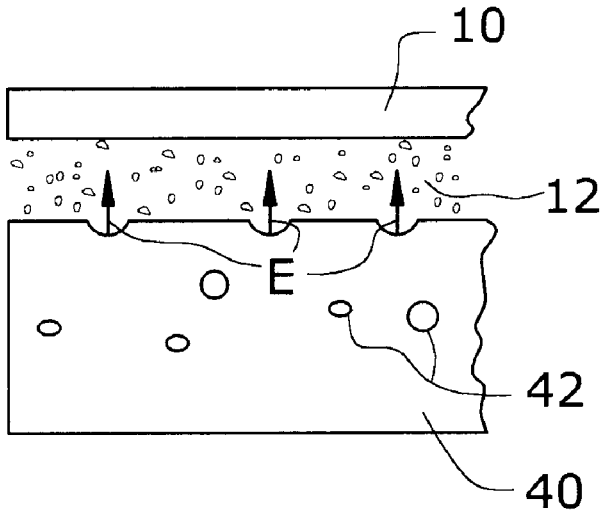
FIG. 5 Prior Art
FIG. 5 is a partial schematic side view of a conventional CMP pad with isolated porosity as it polishes a wafer.
Figure 8:
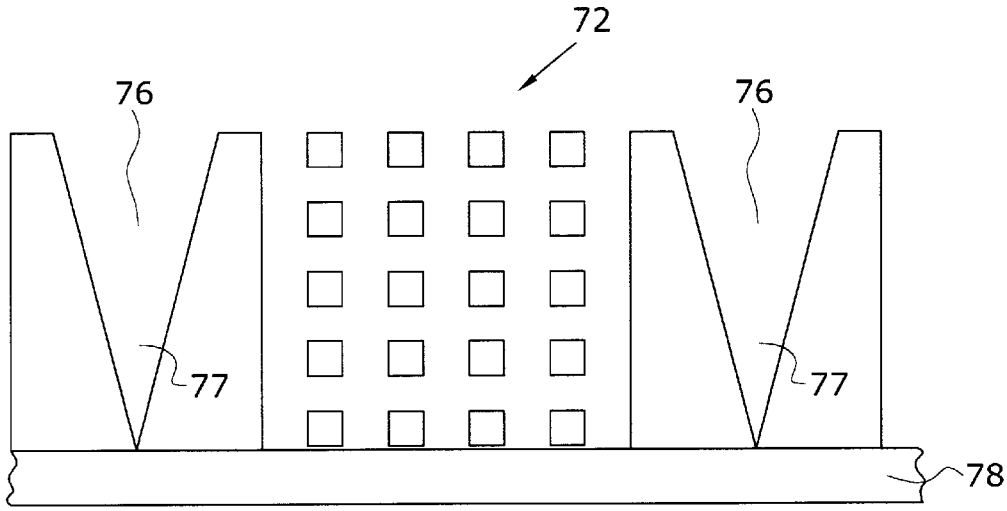
FIG. 8 is a partial schematic side view of the CMP pad of FIG. 6.

Referring now to FIGS. 6–8, in which like numerals denote like elements, there is shown a CMP pad 70 which has a matrix of isolated pockets of continuous porosity interspersed with a non-porous areas. Specifically, the CMP pad 70 includes porous sections 72, each of which include a plurality of interconnected pores 74. The porous sections 72 are separated from each other by a non-porous section 76. A lower layer 78 (FIG. 7) is adhered or bonded to the non-porous section 76 and the porous sections 72, preferably via adhesive, adhesive melt, reactive bonding, sintering, etc.

The presence of the continuously porous sections 72 allows the slurry 12 to be held locally for polishing. Presence of non-porous sections prevent macro slurry flow and thus allows pressure build-up, providing lift (FIGS. 1–5) during polishing. The build up of pressure leads to localized hydrodynamic lift at the porous sections 72.

The CMP pad 70 may be formed from a continuously porous pad. If a continuously porous pad is utilized, the non-porous section 76 may be formed from a porous area by creating a trench structure 77 with non porous sidewalls through an originally porous area. Any suitable method for creating the trench structure 77 may be utilized. One preferred method includes forming the trench structure 77 by melting or sintering a particular porous area to close off any pores in that area as well as seal off adjacent porosity. The formation of a network of trench structures 77 in the non-porous section 76 provides an added benefit of additional macroscopic slurry transport. It should be understood that the size of each of the various segregated continuously porous sections 72 is substantially smaller than the size of the wafers polished by the pad 70. The trench structures 77 may be tapered as illustrated, or alternatively, the trench structures 77 may be straight walled.

Figure 9:
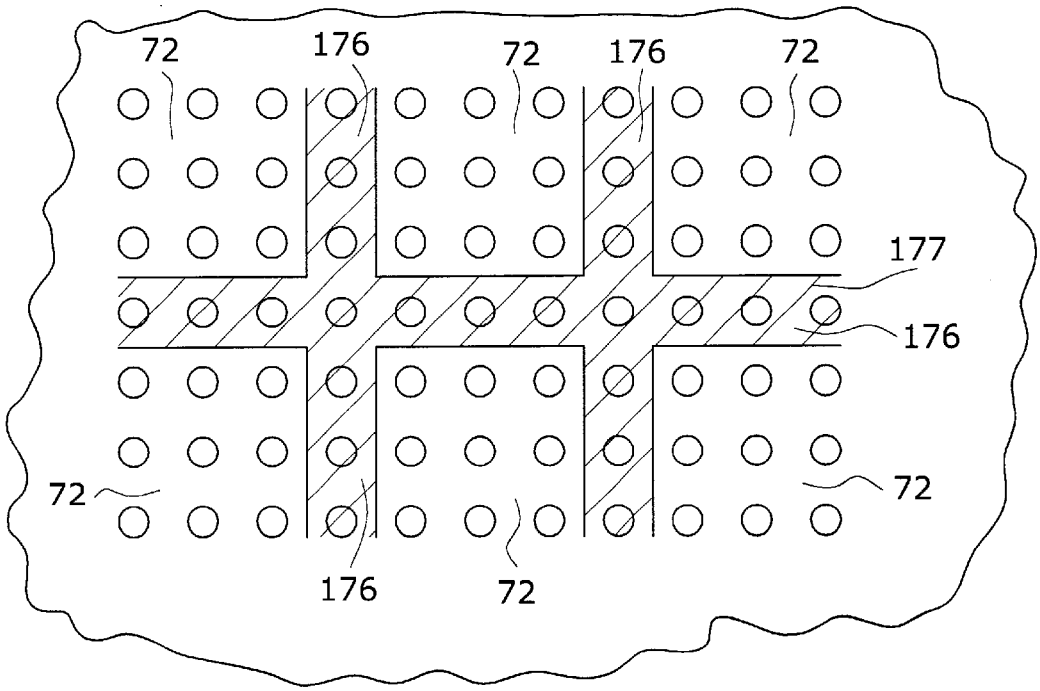
FIG. 9 is a partial schematic top view of a CMP pad constructed in accordance with another embodiment of the invention.

Alternatively, as illustrated in FIG. 9, a non-porous section 176 may be formed by introducing material 177 which moves into previously porous areas. The material 177 may include a solid polymer resin. The material 177 serves to isolate each of the porous section 72.

Figure 10:
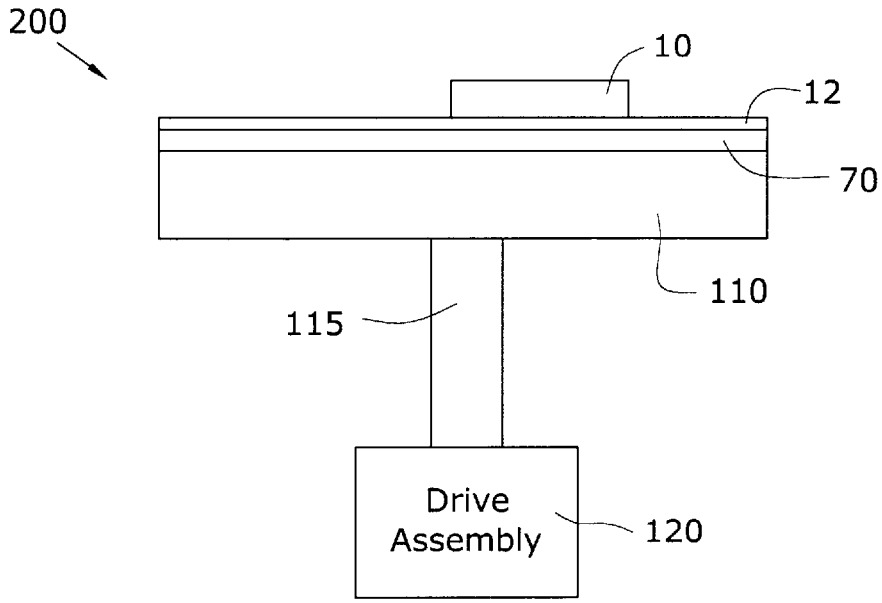
FIG. 10 is a schematic side view of a polishing system constructed in accordance with an embodiment of the invention.

A system 200 for polishing wafers 10 is shown in FIG. 10. The system 200 includes a platen 110 on which the CMP pad 70 is mounted. Slurry 12 is delivered between the CMP pad 70 and the wafer 10. The platen 110, and thus the CMP pad 70, is rotated by a drive assembly 120 via a drive shaft 115.

Figure 11:
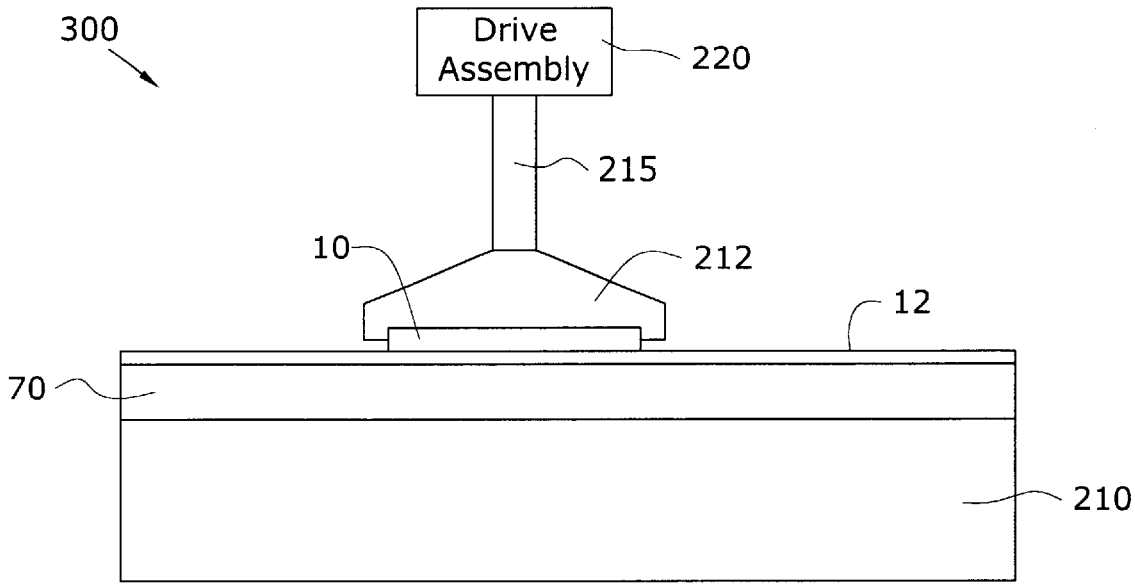
FIG. 11 is a schematic side view of a polishing system constructed in accordance with another embodiment of the invention.

Alternatively, as shown in FIG. 11, a system 300 includes a drive assembly 220 which rotates the wafer 10, while the CMP pad 70 remains stationary. The drive assembly 220 rotates the wafer 10 through a drive shaft 215 which is connected to a wafer holder 212. The CMP pad 70 is mounted on a stationary platen 210.

Instead of the illustrated systems 200 and 300, a polishing system may employ drive assemblies which rotate both the wafer 10 and the CMP pad 70. Such a system would include the drive shaft 115 and drive assembly 120 (FIG. 10) and the wafer holder 212, drive shaft 215, and drive assembly 220 (FIG. 11). The drive assemblies 120, 220 may rotate the wafer 10 and the CMP pad 70 in the same direction or opposite directions. It should be appreciated that the illustrated systems 200, 300 are merely exemplary, as there are many types of systems which may be used, such as web polishers and oscillating and orbital polishers.

Figure 12:
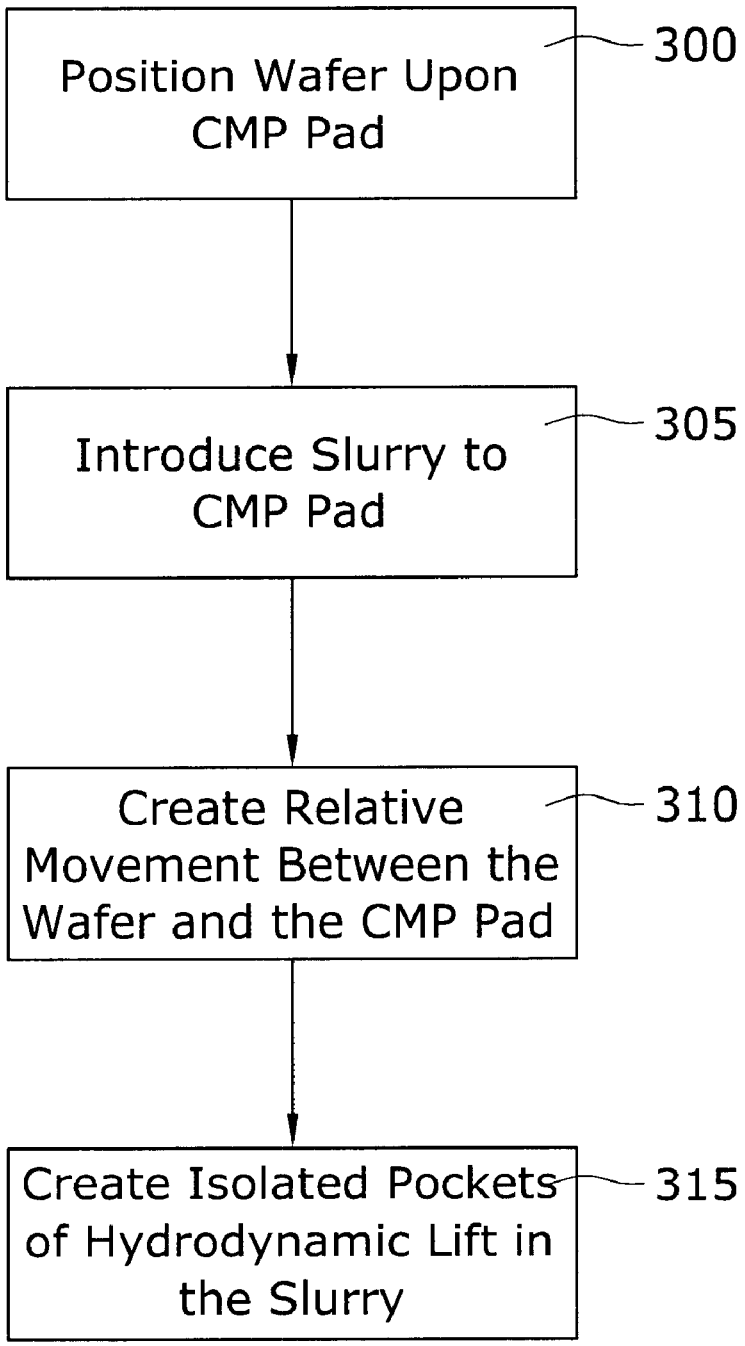
FIG. 12 illustrates a process for polishing a wafer in accordance with an embodiment of the invention.

FIG. 12 illustrates a methodology for polishing a wafer using the CMP pad 70 in conjunction with any of the above described polishing systems. Step 300 includes positioning the wafer 10 on the CMP pad 70. Next, at step 305, the slurry 12 is between the CMP pad 70 and the wafer 10. Obviously, steps 305 and 300 can be reversed in order. Once sufficient slurry 12 has been introduced between the wafer 10 and the CMP pad 70, relative rotation is created between them at step 310. The relative rotation may be created by rotating the platen 110 relative to the wafer 10 through the drive assembly 120 (FIG. 10), by rotating the wafer holder 212 relative to the CMP pad 70 through the drive assembly 220 (FIG. 11), or by rotating both the platen 110 and the wafer holder 212 with the drive assemblies 120, 220. The combination of the relative rotation and the use of the CMP pad 70 creates isolated pockets of hydrodynamic lift in the slurry 12 at step 315.

Figure 13:
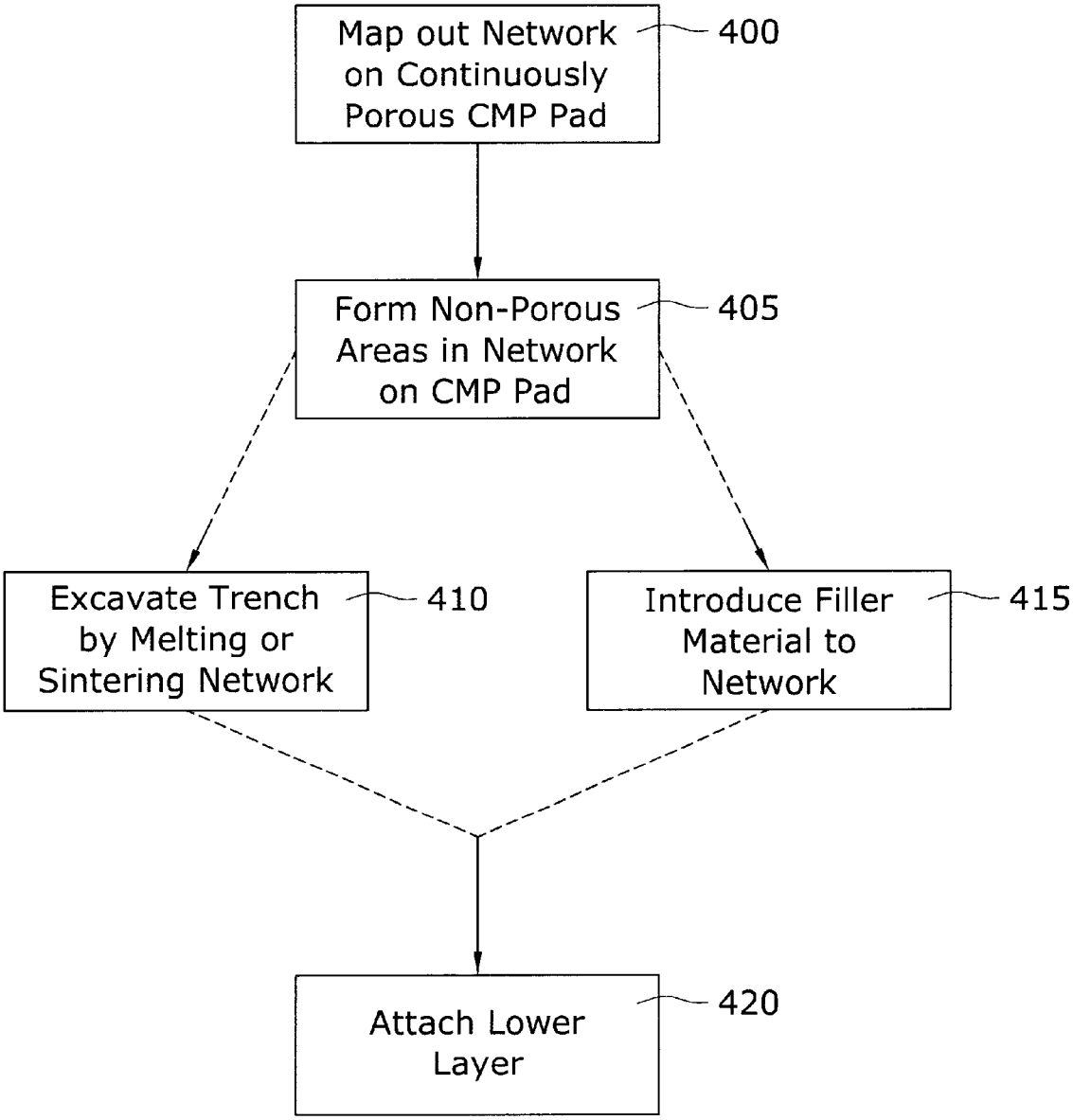
FIG. 13 illustrates a process for fabricating a chemical mechanical polishing pad in accordance with an embodiment of the invention.

FIG. 13 illustrates a methodology for fabricating a chemical mechanical polishing pad. After obtaining a CMP pad which is continuously porous throughout, at step 400 a network is mapped out on the pad. The network is to be of such design or pattern as to segregate a plurality of areas of the CMP pad from each other. For example, the network may have intersecting portions. The mapping may be visual only, or instead it may be performed by marking out the areal extent of the network on the pad itself. At step 405, the network is transformed into a non-porous area. The network may be transformed into a non-porous area by excavating a trench as shown at step 410. The trench may be formed by melting or sintering of the network. Instead, the network may be transformed into a non-porous area by introducing a filler material, such as a solid polymer resin, to the network as shown at step 415. Alternatively, the CMP pad 70 may be formed by fabricating a grid of solid material or material having isolated porosity, and fabricating porous sections and assembling the porous sections within the grid so as to segregate the porous sections one from the other. At step 420, the lower layer 78 (FIG. 7) is attached to the porous and non-porous sections 72, 76. Attachment of the lower layer 78 may be accomplished through adhesive, adhesive melt, reactive bonding, sintering or any other suitable attachment mechanism.

While the invention has been described in detail in connection with exemplary embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A chemical mechanical polishing pad, comprising:

a plurality of continuously porous sections each including a plurality of interconnected pores; and a non-porous section which separates each of said continuously porous sections from another of said continuously porous sections.

2. The chemical mechanical polishing pad of claim 1, wherein said non-porous section comprises a network of trenches.

3. The chemical mechanical polishing pad of claim 1, wherein said network of trenches comprises tapered trenches.

4. The chemical mechanical polishing pad of claim 2, wherein said network of trenches comprises straight walled trenches.

5. The chemical mechanical polishing pad of claim 1, wherein said non-pourous section comprises a material which resides in pores to form said non-porous section.

6. The chemical mechanical polishing pad of claim 5, wherein said material comprises a polymer resin.

7. The chemical mechanical polishing pad of claim 1, wherein said non-porous section comprises a solid material.

8. The chemical mechanical polishing pad of claim 1, further comprising a lower layer adhered to said continuously porous sections and said non-porous sections.

9. The chemical mechanical polishing pad of claim 1, wherein said non-porous sections are adapted to inhibit macro slurry flow during polishing.

10. The chemical mechanical polishing pad of claim 9, wherein said non-porous sections are adapted to enable an increase of pressure during polishing, thereby leading to localized hydrodynamic lift in said continuously porous sections.

11. The chemical mechanical polishing pad of claim 1, wherein the pad is formed from one or more materials in the group consisting of polyurethane and interlocking felt fiber.

* * * * *